US008162028B2

(12) United States Patent
Bengtsson et al.

(10) Patent No.: US 8,162,028 B2
(45) **Date of Patent: *Apr. 24, 2012**

(54) HIGH LOAD OPERATION OF AN INDUSTRIAL ROLL DOOR

(75) Inventors: Mikael Bengtsson, Eldsberga (SE); Hakan Larsson, Halmstad (SE); Raymond Sauve, Stone Mountain, GA (US); Holger Siewert, Rheda-Wiedenbrueck (DE); Jan Victor, Halmstad (SE); Kent Palsson, Aled (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 1131 days.

This patent is subject to a terminal disclaimer.

(21) Appl. No.: 11/587,226

(22) PCT Filed: May 2, 2005

(86) PCT No.: PCT/US2005/014700

§ 371 (c)(1), (2), (4) Date: Jul. 12, 2007

(87) PCT Pub. No.: WO2005/108732

PCT Pub. Date: Nov. 17, 2005

(65) Prior Publication Data

US 2008/0041536 A1 Feb. 21, 2008

(51) Int. Cl.
*A47H 1/00* (2006.01)
*E06B 3/94* (2006.01)

(52) U.S. Cl. ..... 160/265; 160/133

(58) Field of Classification Search ..... 160/265, 160/191, 192, 322, 133, 264, 290.1
See application file for complete search history.

(56) References Cited

U.S. PATENT DOCUMENTS

| | | | | |
|---|---|---|---|---|
| 4,653,567 | A * | 3/1987 | Starcke et al. | 160/301 |
| 5,025,847 | A * | 6/1991 | Mueller | 160/270 |
| 5,129,442 | A * | 7/1992 | Warner | 160/271 |
| 5,159,967 | A * | 11/1992 | Ashley et al. | 160/265 |
| 5,222,541 | A | 6/1993 | Hornberger | |
| 5,474,117 | A | 12/1995 | Henkenjohann | |
| 5,632,317 | A * | 5/1997 | Krupke et al. | 160/265 |
| 5,930,865 | A * | 8/1999 | Mihalcheon | 16/197 |
| 6,019,156 | A * | 2/2000 | Wagner et al. | 160/310 |
| 6,439,292 | B1 | 8/2002 | Schutte et al. | |

* cited by examiner

*Primary Examiner* — Darnell Jayne
*Assistant Examiner* — Jeremy Ramsey
(74) *Attorney, Agent, or Firm* — Frommer Lawrence & Haug LLP; Ronald R. Santucci

(57) ABSTRACT

A high load operation industrial roll door, including a flexible door curtain windable about a top roll positioned above a door opening and provided with a drive system. The roll door includes a bottom beam fastened to the door curtain, and a biasing spring, for resisting movement of the door upon application of a load thereon, and a positive stop preventing movement of the biasing means beyond a predetermined point.

66 Claims, 10 Drawing Sheets

HIGH LOAD OPERATION OF AN INDUSTRIAL ROLL DOOR

This application is a 371 of PCT/U.S.2005/014700 filed on May 2, 2005, published on Nov. 17, 2005 under publication number WO 2005/108732 A which claims priority benefits from U.S. patent application Ser. No. 10/838,783 filed May 4, 2004.

FIELD OF THE INVENTION

The present invention relates to the high load operation of an industrial roll door. More specifically, the invention relates to a roll door comprising a door blade, or curtain, which is windable about a roll that is provided with a drive system, a biasing means, and means for preventing the biasing means from traveling beyond a predetermined point, so to prevent movement of the curtain when an external load is applied.

BACKGROUND OF THE INVENTION

Since the 1970's there has been a great need to use rapidly moving doors in buildings for industrial use. This applies to openings indoors as well as in external walls, where the door provides shielding between different activities or prevents drafts and heat losses. Presently, rolling doors with flexible door leaves are used for this purpose, but also more rigid constructions like slatted doors with polymeric or metallic lamellae are used. These doors are rolled up on an overhead drive cylinder and can be provided with additional elements like transverse wind reinforcements on the door leaf to counteract wind load, a weight balance system, tensioning system, windows or the like. For safety reasons, rolling doors can be further provided with safety edge protection, failsafe devices, drop protection, and crash safety functions.

U.S. Pat. No. 5,222,541 teaches a roll-up industrial door with a counter-balancing and tensioning system which counter-balances the weight of the door panel and, through a biasing mechanism, applies a downward tension to the closed door panel to stretch the panel and resist wind deflection. It is noted that the system operates with constant force in the pull-down direction, but contains no locking of the door leaf in the lower position. In any case, the invention is primarily directed to a break-away function.

U.S. Pat. No. 5,474,117 describes a locking mechanism for a roll-up closure with horizontal slats. The lowermost and uppermost slats carry spring-biased pins which resist unintentional lifting of the closure. The drawings of this patent shows a door locked at the bottom. It is noted that similar solutions have been previously proposed, but mainly as catching devices.

A related door construction is disclosed in U.S. Pat. No. 5,632,317. The invention is a roll-up door assembly with a number of embodiments including a moveable barrier bar to minimize deflection of the door closure member, or curtain, due to wind or other pressure generating forces. However, this solution is very complex and contains expensive elements. In addition, manual locking of the door is also provided for added wind resistance.

U.S. Pat. No. 6,439,292 is a roll-up door with a crash safety system that can automatically return the door to an operational condition. In the event that the door is not automatically restored to operation, it can be restored manually. It is noted that this patent presents a break-away function in combination with a photocell for safe operation during opening and closing of the door.

While some of the foregoing references have certain attendant advantages, further improvements and/or alternative forms, are always desirable.

SUMMARY OF THE INVENTION

It is an object of the present invention to provide an industrial door that reduces the potential for trespassing and unwanted draft by substantially reducing the bulging of the industrial door in the vertical direction.

It is another object of the present invention to provide an industrial door that safely restricts the door blade edges to guide channels, and thereby prevents unwanted trespassing by substantially reducing the bulging of the industrial door in the horizontal direction.

It is another object of the present invention to provide an industrial an industrial door that safely can withstand unwanted inwards or outwards bulging of the door curtain in machine protection door installations. The inwards bulging may be caused by people falling into the door. The outwards bulging may be caused by e.g., robot arms or by goods that are thrown around by a runaway robot.

The present invention provides a high load operation industrial roll door. One embodiment of the present invention described herein provides a positive stop inserted into a tensioning/counter-balance mechanism of the door. This positive stop prevents a counterbalance spring or other biasing means from moving beyond a certain point, thereby keeping the door curtain in a closed position when subjected to high winds or other external forces that cause heavy loading on the door.

These embodiments typically comprises a door curtain which is windable about a roll that is provided with a drive system, a biasing means operable to stretch when a load is applied to the curtain, a cable having a first end connected to the bottom of the curtain, the cable running therefrom over pulleys, a second end of the cable being connected to a cable drum, and a positive stop preventing the biasing means from traveling beyond a predetermined point, so to prevent movement of the closed curtain when an external load is applied thereto.

Another embodiment of the present invention includes an extra pulley and a divided cable. This embodiment also includes a roll and cable drum provided with a drive system; a door curtain to be wound upon the roll and unwound from the roll; a biasing means operable to travel/stretch when a load is applied to the curtain; a first cable to be wound/unwound from the cable drum and having one end connected thereto, the first cable running therefrom over first and second pulleys and the other cable end being connected to a reduction pulley; and a second cable with one end being fixed, the second cable running therefrom over the reduction pulley and a third pulley, and the other cable end being connected to the bottom of the curtain.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 3:
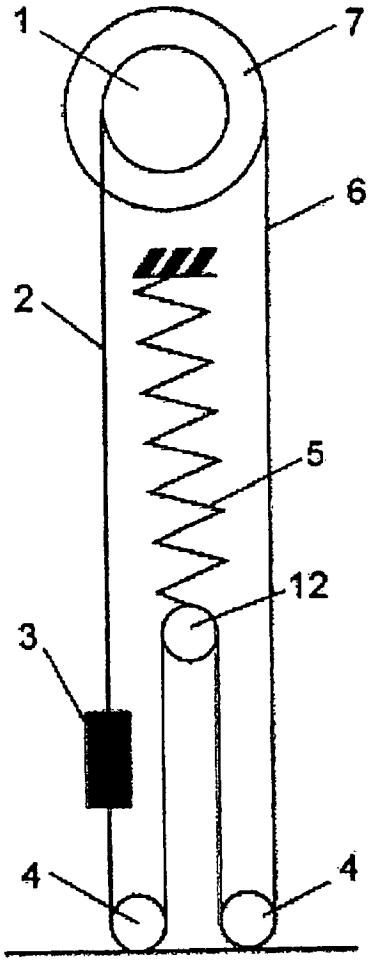
FIG. 3 (PRIOR ART)
FIG. 3 is a side view of a prior art door system with an alternative spring position.
Figure 1:
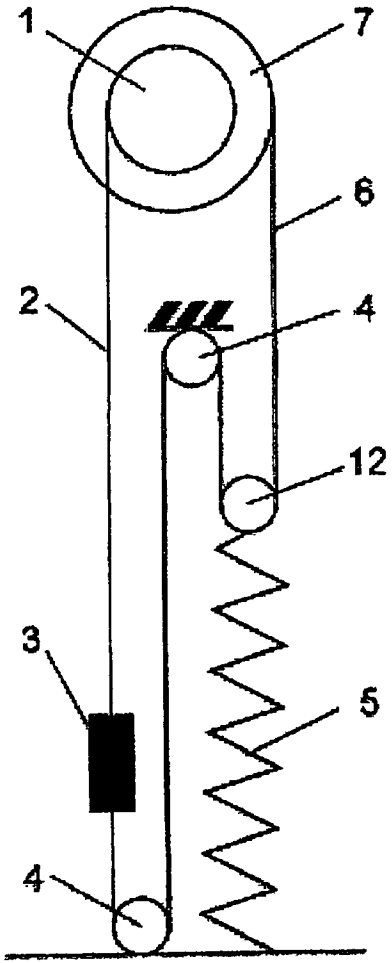
FIG. 1 (PRIOR ART)
FIG. 1 shows, a side elevation view of a prior art door system.

FIGS. 1 and 3 show side views of prior art roll doors with standard tensioning and balancing systems. As can be seen in FIG. 1, a top roll 1 and cable drum 7 are rotatably mounted above the door and provided with a drive system (not shown), with a door curtain (door blade) 2, operable to be wound and unwound about the top roll 1. In addition, a bottom beam 3 is fastened to the bottom end of the door curtain 2. A cable 6 is provided and has one end attached to the bottom beam 3, with the other end attached to the cable drum 7. The cable 6 runs around stationary pulley 4 and over a movable pulley 12 loaded by a biasing tension resistant spring 5. The tension resistant spring 5 can be alternatively positioned at the top of the doorway as shown in FIG. 3. In either case, the spring 5 stretches when the curtain 2 is loaded, for example, by wind or other external forces. However, with the standard door systems shown in FIGS. 1 and 3, the stretching/elongation of the spring tension resistant 5 is unrestricted (except for the internal force of the spring). Unfortunately, this may lead to the unwanted raising of the bottom beam 3 in high wind conditions or when other external forces act on the door curtain 2.

Advantageously, the door tensioning and balance system according to the present invention provides a solution to the above-described problems while avoiding the drawbacks of the prior art door systems. It is appreciated that the cable 6 could be in the form of a wire, a belt, a chain, a cord, a rope, or other configurations without departing from the scope of the present invention. Further alternatives to the top roll 1 may be employed including but not limited to disks located on each side of the door, truss rolls of a desired size or other means known to those of skill in the art.

Figure 2:
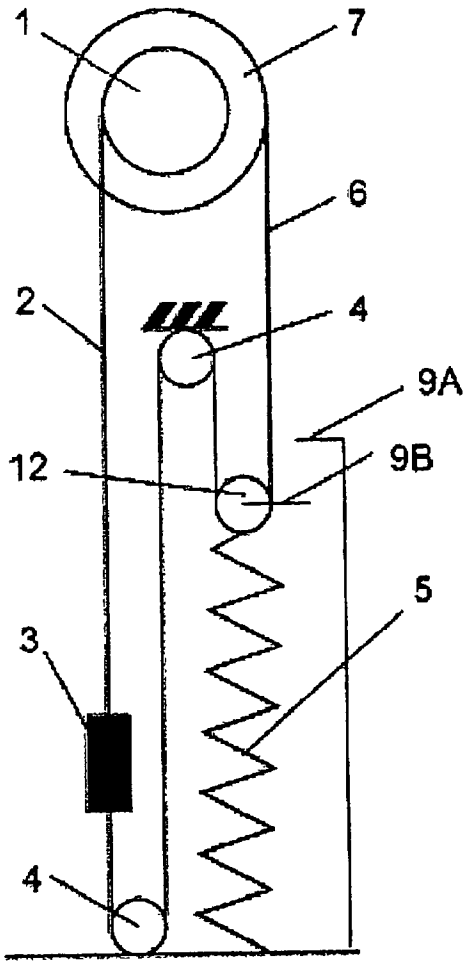
FIG. 2 is a side elevation view of a door system with a positive stop according to the present invention.

As shown in FIG. 2, one embodiment of the invention includes a door curtain 2 windable about a top roll 1 that is positioned above the door opening and provided with a drive system (not shown). A bottom beam 3 is fastened to the end of the curtain 2. A cable 6 is further provided and has one end attached to the bottom beam 3, with the other end attached to the cable drum 7. The cable 6 runs around stationary pulleys 4 and over a movable pulley 12 loaded by a biasing tension resistant spring 5. The tension resistant spring 5 stretches when the curtain 2 is loaded.

Whereas spring elongation is unrestricted in a standard tensioning system, the present invention, as shown in FIG. 2, provides a rigid elongation stopper or mechanical stopper ("positive stop") 9A and 9B to prevent the tension resistant spring 5 from moving beyond a certain point. Advantageously, this prevents the bottom beam 3 from rising when high winds or other external forces cause a heavy loading on the door curtain 2. The positive stop 9 can comprise, as one example, a first member 9A which, when the spring stretches, engages a second member 9B affixed to the pulley 12. The mechanical stop mechanisms 9 described herein resists not only wind but also high loads caused by air-conditioning, fans and the like, or vertical forces applied to the door curtain 2 by an intruder, for example. In addition, means can be provided for fixing the bottom beam 3 in a closed position, for example, by using mechanical or electromechanical locks.

Restricting the elongation of the tension resistant spring 5 provides tension between the bottom beam 3 and the top roll 1. This, in turn, prevents external loading of wind or other forces from raising the bottom beam 3, since movement thereof is restricted via the cabling 6, as long as the top roll 1 does not move. The movement of top roll 1 can be prevented by a motor brake, or in extreme conditions, by adding a supplemental locking device. Incidentally, it is noted that cable 6 elongation under loading can reduce the effectiveness of the device, and that, therefore, care should be taken in selecting the cable 6 so to minimize unwanted elongation. Further, one of skill in the art will appreciate that the springs 5 and 13 could in fact be a combination of two or more springs (see for example springs 5 in FIG. 15) which could be positioned in a variety of positions including attached to either to top or bottom of the doorway or inside of the top roll. Springs 5 and 13 can further be located on one or both sides of the door, and can be connected in parallel or serial arrangement. Further, those of skill in the art will understand that the springs 5 and 13 can be made of rubber ropes that are connected in parallel or formed in loops. Similarly, a pneumatic or gas spring, or hydraulic spring can be substituted for the springs 5 and 13 in each of the embodiments of the present invention.

Those of skill in the art will understand that the door curtain 2 can comprise coated fabrics, polymeric film, flexible or rigid slats or lamellae, or any other materials that can be rolled up. In addition, the door curtain can be flexible in all directions, or flexible only in the rolling direction while being made substantially inflexible in other directions via stiffing members fastened to the door curtain 2, or via other suitable means. Additionally, instead of being vertical, the door can be horizontal so to operate sideways, or can even be installed on an angle. Note also that the bottom beam 3 need not be included, in which case the cable(s) 6 can be fixed to the bottom corners of the door curtain 2.

As described above, the present invention provides certain advantages over prior proposals for preventing the raising of the door in high wind conditions or when other forces act on the door curtain 2. For example, one prior art door system provides high amounts of tension from the tension/balance system at open positions, but this is considered undesirable since this introduces instability to mechanical door systems. It is further noted that locking systems have been employed, but are disadvantaged by additional costs and complexity. The advantages provided by the door system according to the present invention, on the other hand, include high reliability, low cost, and, in particular, the flexibility to provide crash functions.

It is noted that prior art attempts at designing an anti-crash function for a door with a high pulldown tensioning system have proved problematic. For example, one prior art door design, a so-called "Posidrive" system, limits the inclusion of a anti-crash function, due to a requirement that the bottom beam 3 be rigidly connected to the drive system.

The design of the present invention, on the other hand, provides the higher pull down tension only at the closed position of the door. This means that at intermediate positions of door movement, the bottom beam 3 is less tensely connected to the drive system. (Note, however, that the springs 5 or 13 always provides some tensioning of the curtain 2). Accordingly, the use of an anti-crash system in conjunction with the present invention is simplified by this more flexible coupling of the bottom beam 3 to the drive system.

One example of an anti-crash device releases the door curtain from the guide channels, in which the door curtain is raised and lowered, upon application of a high external force, such as when hit by a vehicle or other moving object. Anti-crash devices do not release the door when subjected to high wind conditions or by forces applied by burglar attacks, for example. It is noted that the anti-crash systems typically operate best when the door is in the "almost open" position (where most collisions occur), and are generally less effective as the door reaches the closed position. Anti-crash devices may include a variety of mechanical or electromechanical designs, including but not limited to a pin that is broken at some threshold pressure, a sensor connected to a release device, or a spring-loaded arrangement. An anti-crash device is optionally included in each of the embodiments described herein.

Figure 6:
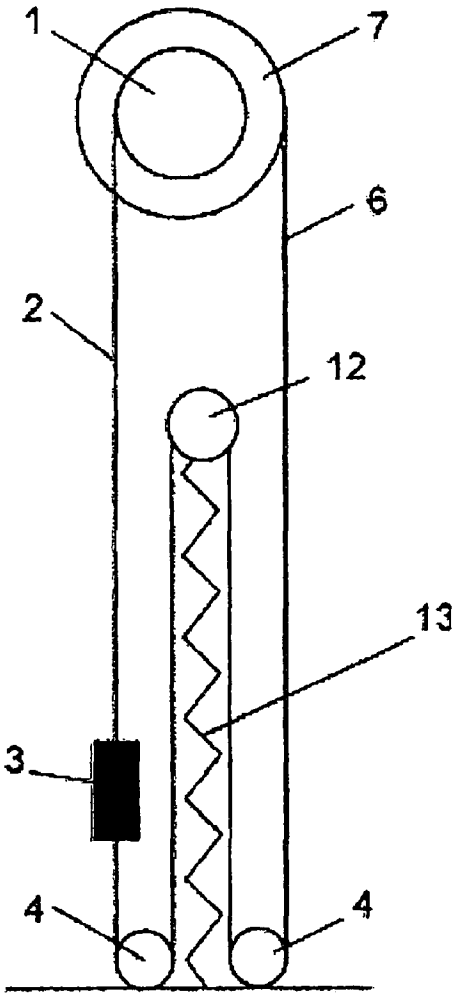
FIG. 6 is a side view of a door system with a spring stop in an alternate position according to the present invention.
Figure 5:
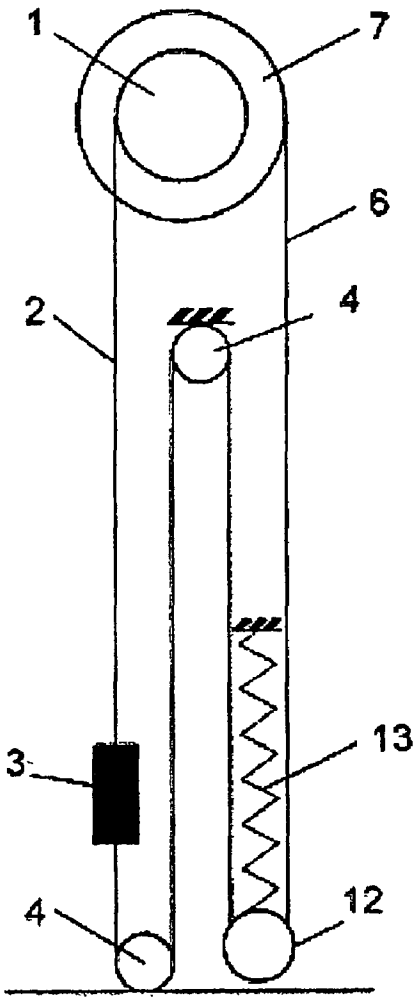
FIG. 5 is a side view of a door system with a spring stop according to the present invention.
Figure 4:
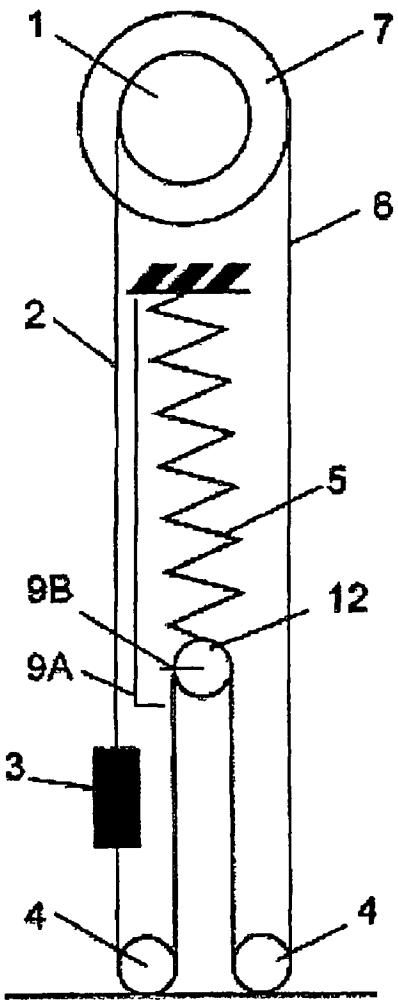
FIG. 4 is a side view of a door system with a mechanical stop and an alternate spring position according to the present invention.

FIGS. 4-6 illustrate further variations of the present invention. For example, FIG. 4 shows an embodiment wherein the spring tension resistant 5 is positioned near the top of the doorway instead of at the bottom. FIGS. 5 and 6 show further variations wherein a compression resistant spring 13 is provided instead of a tension resistant spring 5, as shown in FIG. 1. The compression resistant spring 13 can be positioned either extending downward as shown in FIG. 5, or extending upward as shown in FIG. 6. In either case, the compression resistant spring 13 itself functions as the positive stop when the spring 13 is fully compressed. Note that with each of the embodiments shown in FIGS. 4-6, restricting elongation or compression of the of the spring 5 or 13 advantageously prevents the bottom beam 3 from rising when external forces act on the door curtain 2. The compression spring elements shown in these drawings could also represent a spring element consisting of compression springs in series or parallel arrangements.

Figure 9:
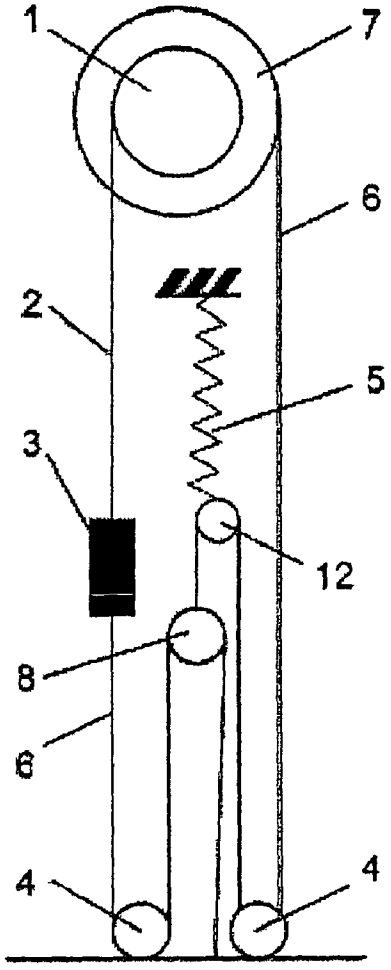
FIG. 9 is a side view of a door system with a reduction pulley and an alternative spring position according to the present invention.
Figure 7:
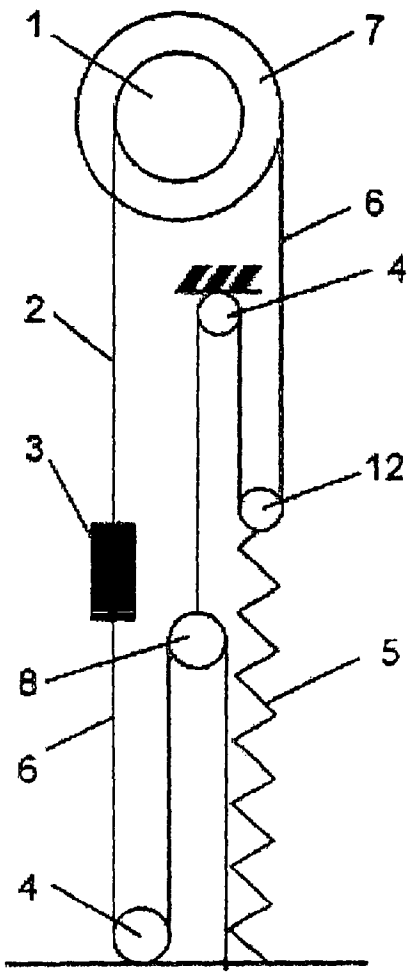
FIG. 7 is a side view of a door system with a reduction pulley according to the present invention.
Figure 9A:
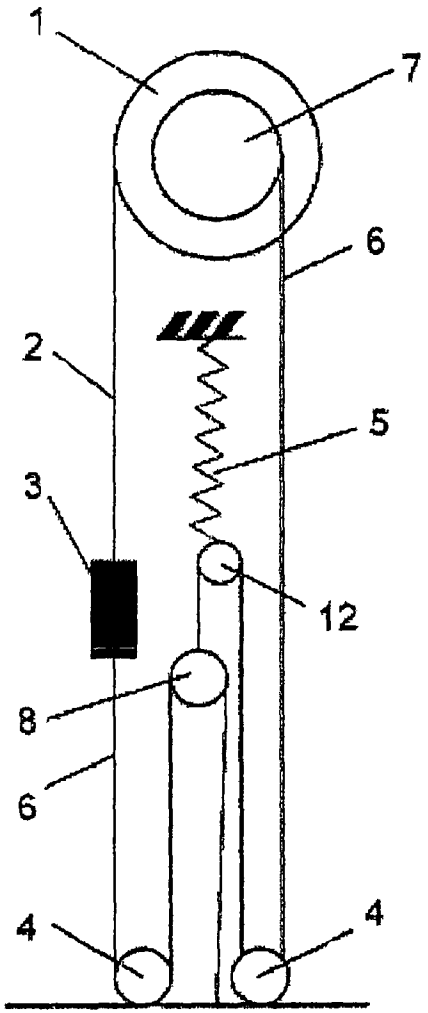
FIG. 9A is a side view of the door system shown in FIG. 9 where the cable drum is smaller than the top roll.
Figure 8A:
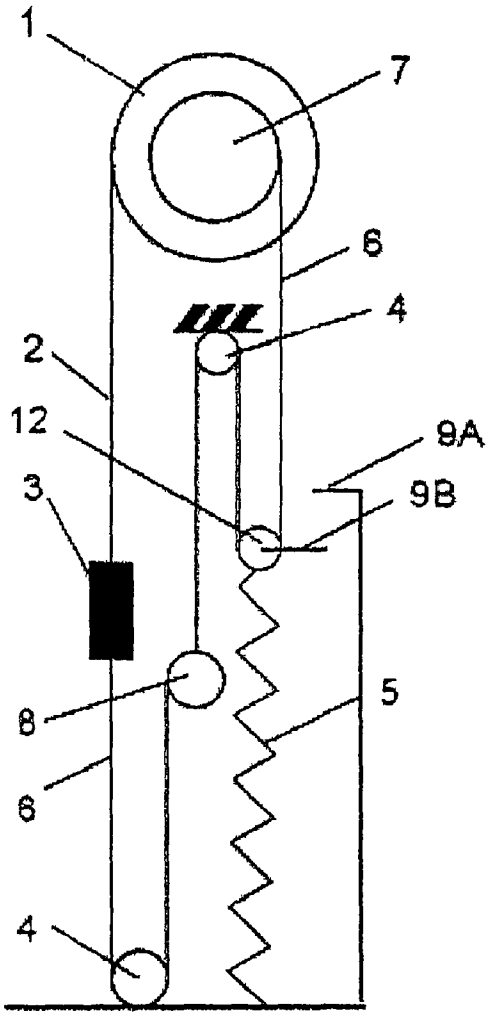
FIG. 8A is a side view of the door system shown in FIG. 8 where the cable drum is smaller than the top roll.
Figure 7A:
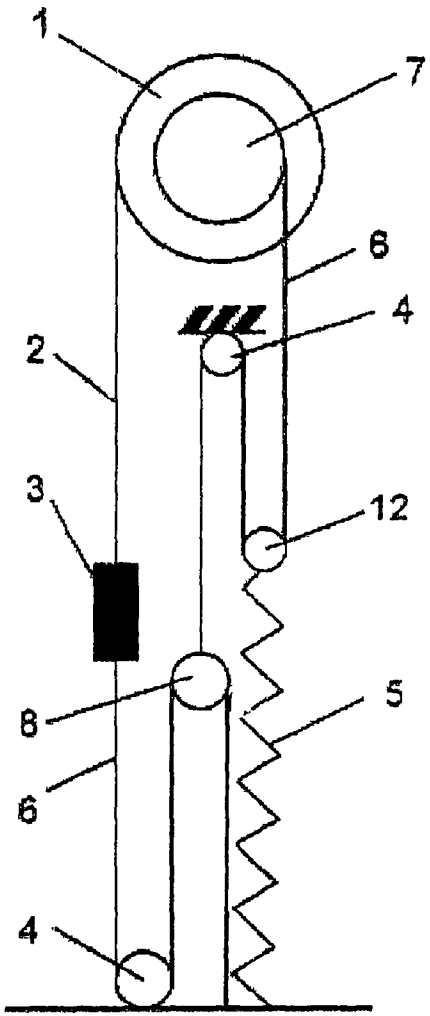
FIG. 7A is a side view of the door system shown in FIG. 7 where the cable drum is smaller than the top roll.

FIGS. 7-12 show further variations of the invention wherein an extra pulley 8 ("reduction pulley") and a divided cable 6 are provided. It should be noted that FIGS. 7A, 8A, 9A, 10A, 11A, and 12A each shows a slight variation of FIGS. 7, 8, etc., where the cable drum 7 has a smaller diameter than the top roll 1. The divided cable 6 arrangement achieves the advantage of a reduced pull down force and allows for a reduced cable drum diameter, which provides both economic and space consideration savings. For example, the embodiment shown in FIG. 7 provides a door curtain 2 having a bottom beam 3 and which winds about a top roll 1. A first cable portion 6 has one end connected to the cable drum 7 and runs over the pulley 12 loaded by the tension resistant spring 5, then over a stationary pulley 4, and the other cable end is connected to the reduction pulley 8. A second cable portion 6 has one end attached to the bottom beam 3, and runs therefrom over stationary pulley 4 and over the reduction pulley 8, and the other cable end is fixed near the bottom of the doorway. The tension resistant spring 5 can be alternatively positioned at the top of the doorway as shown in FIG. 9.

Figure 8:
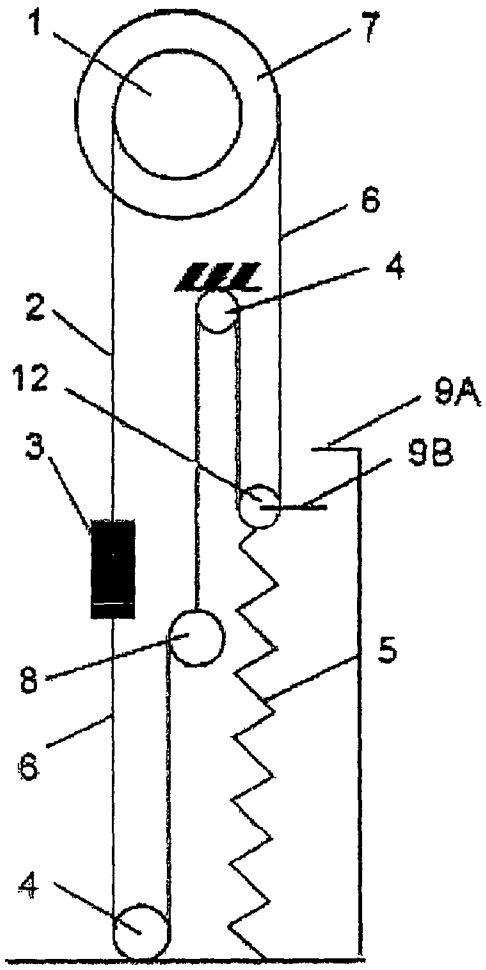
FIG. 8 is a side view of a door system with a reduction pulley and a mechanical stop according to the present invention.
Figure 12:
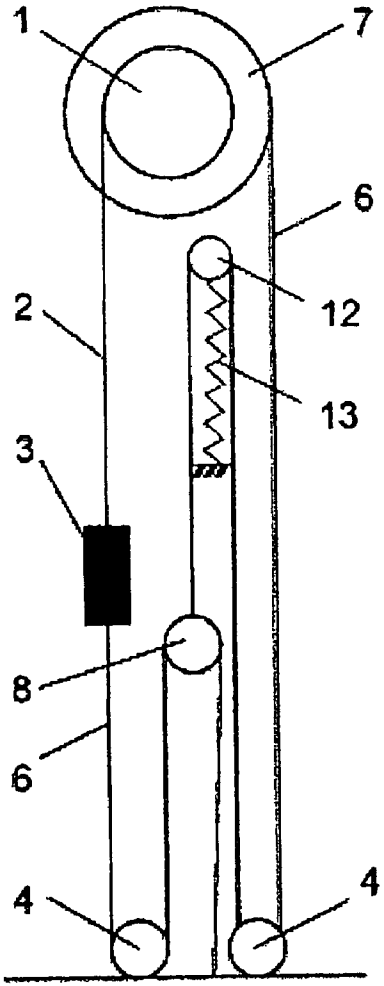
FIG. 12 is a side view of a door system with a reduction pulley and a spring stop in an alternate position according to the present invention.
Figure 11:
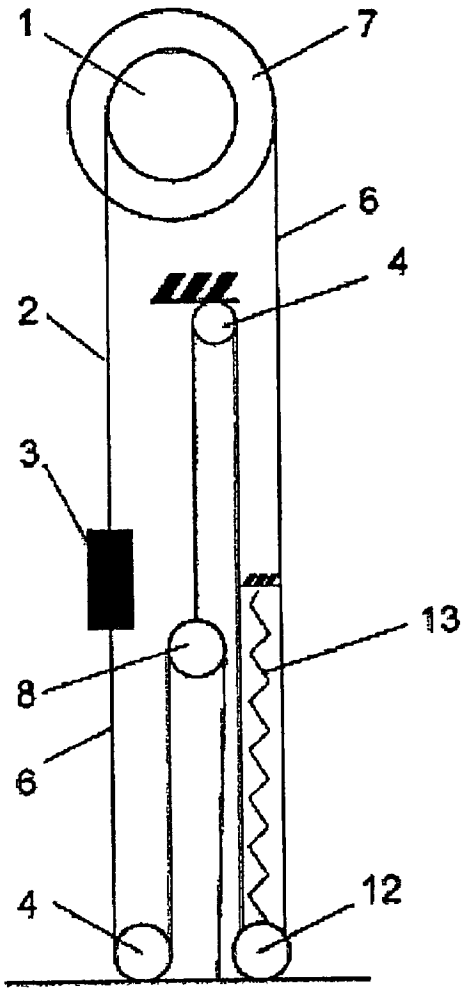
FIG. 11 is a side view of a door system with a reduction pulley and a spring stop according to the present invention.
Figure 10:
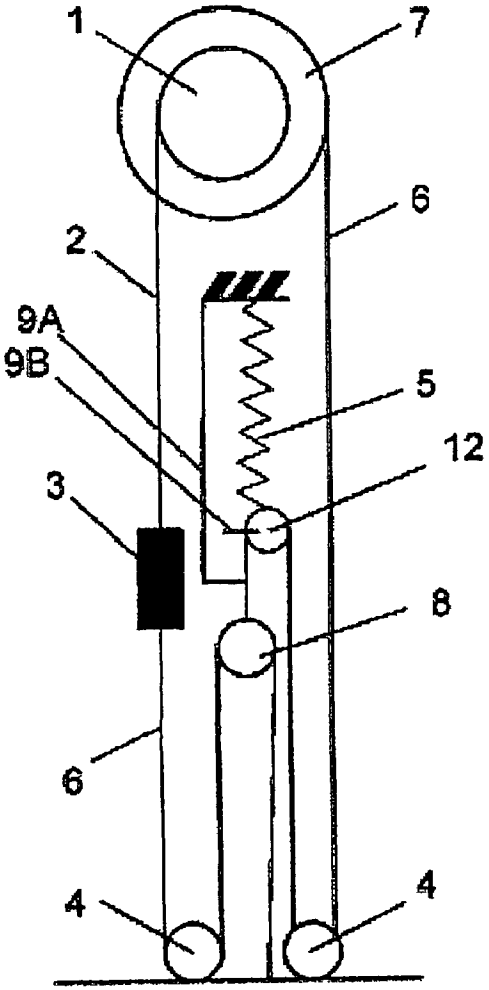
FIG. 10 is a side view of a door system with a reduction pulley, a mechanical stop, and an alternative spring position according to the present invention.
Figure 12A:
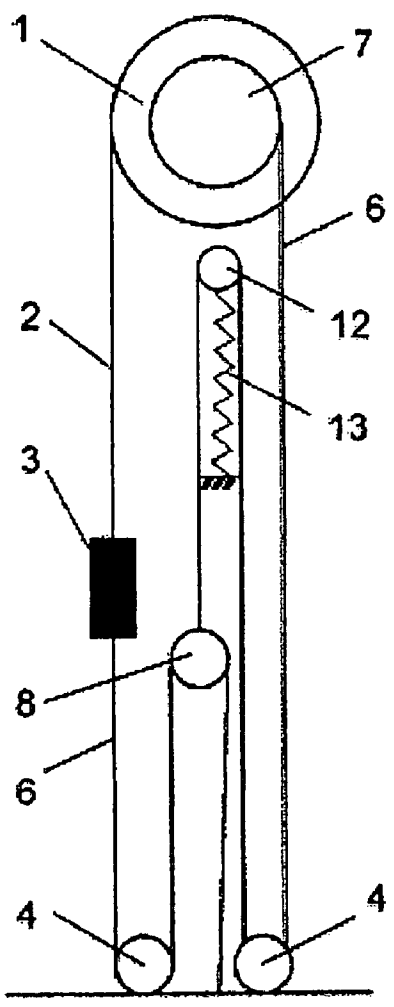
FIG. 12A is a side view of the door system shown in FIG. 12 where the cable drum is smaller than the top roll.
Figure 11A:
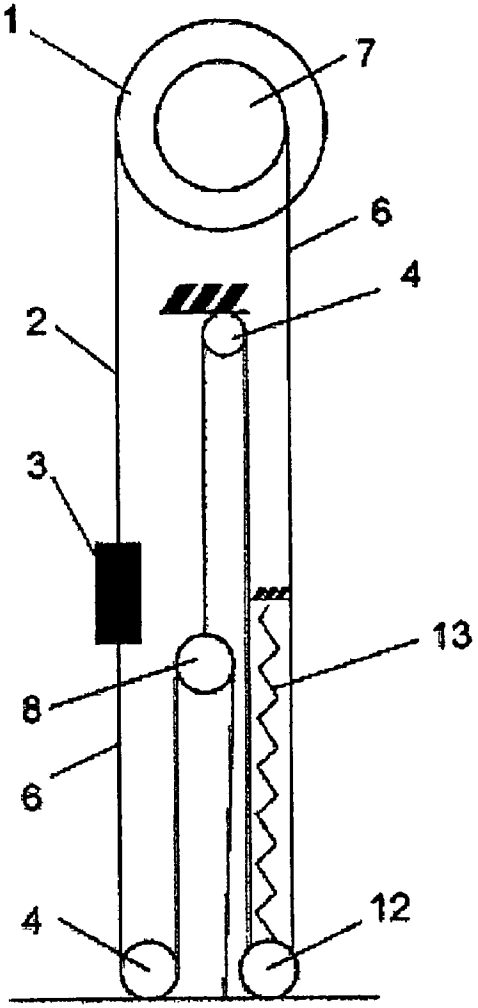
FIG. 11A is a side view of the door system shown in FIG. 11 where the cable drum is smaller than the top roll.
Figure 10A:
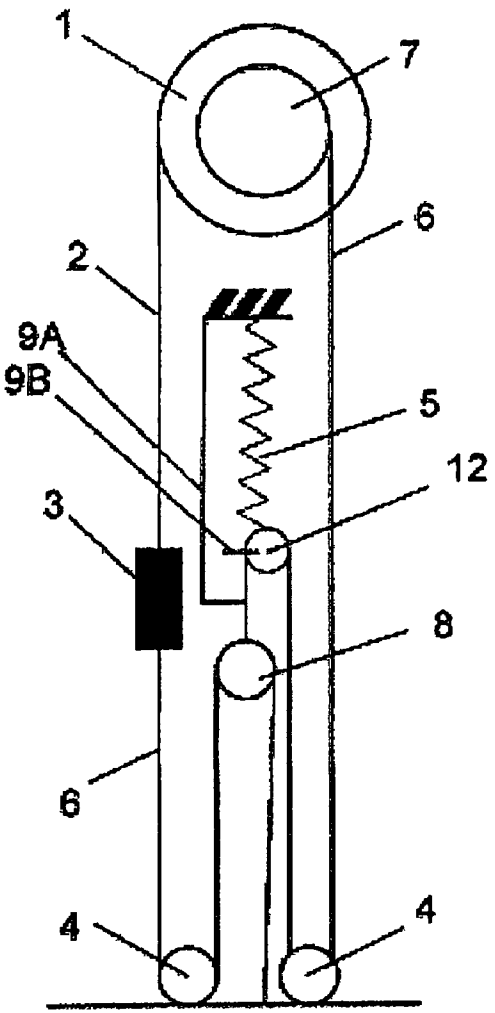
FIG. 10A is a side view of the door system shown in FIG. 10 where the cable drum is smaller than the top roll.
Figure 13:
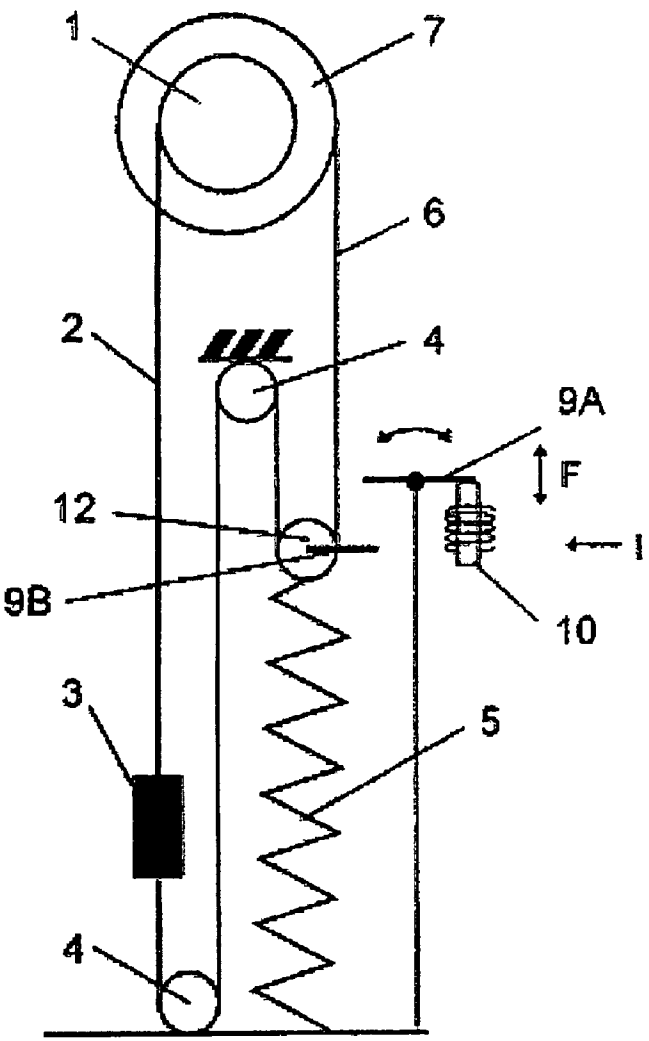
FIG. 13 is a side view of a door system with a pulley and an electro-mechanical positive stop according to the present invention.
Figure 17:
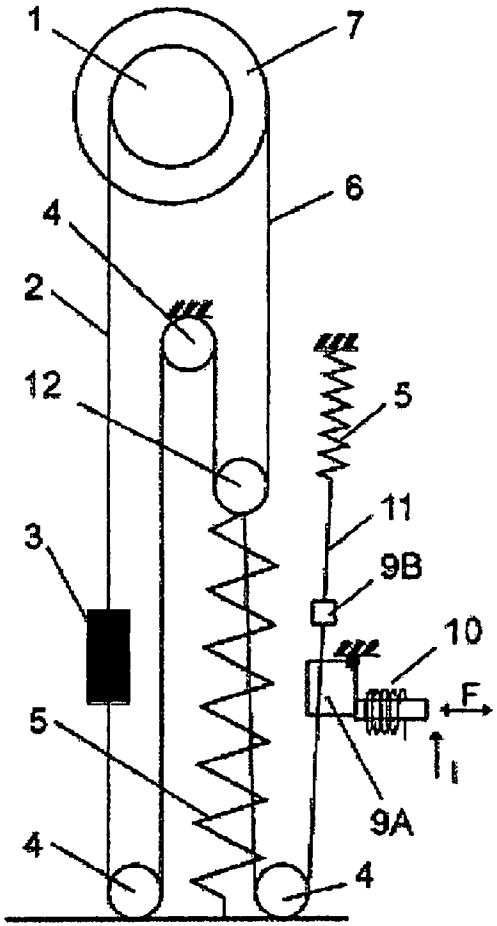
FIG. 17 is a side view of a door system with a pulley and an electro-mechanical stop according to the present invention.
Figure 20:
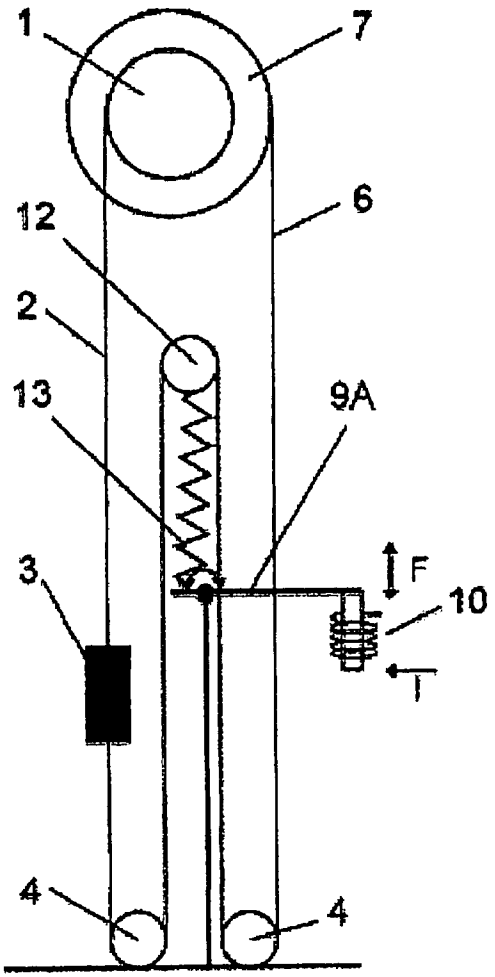
FIG. 20 is a side view of a door system with a pulley and an electro-mechanical pressure spring stop according to the present invention.

In addition, an elongation stopper 9 can be further included as shown in FIGS. 8 and 10. Alternatively, a spring 13 with the stop included can be provided as shown in FIGS. 11 and 12. Thus, in addition to providing the advantage of reduced pull down force and cable drum diameter, the variations shown in FIGS. 8 and 10-12, wherein spring 5 or 13 elongation or compression is restricted, provide the further benefit of preventing curtain 2 movement during high load operation. The elongation stopper 9 can be equipped with a lock and release mechanism 10, for example an electromagnet, as shown in FIGS. 13, 17, and 20, which can be triggered by a sensor or by other suitable means. In each of the embodiments shown in FIGS. 2, 4, 8, and 10, restricting the elongation of the tension resistant spring 5 prevents the bottom beam 3 from rising when external forces act on the door curtain 2. In other embodiments referred to herein, similar lock and release mechanisms operate with similar effect. In addition, the examples provided herein are given by way of example and not intended to limit the scope of the present invention, as other lock and release mechanisms would be clearly recognized as operable herein by those of skill in the art.

Figure 14:
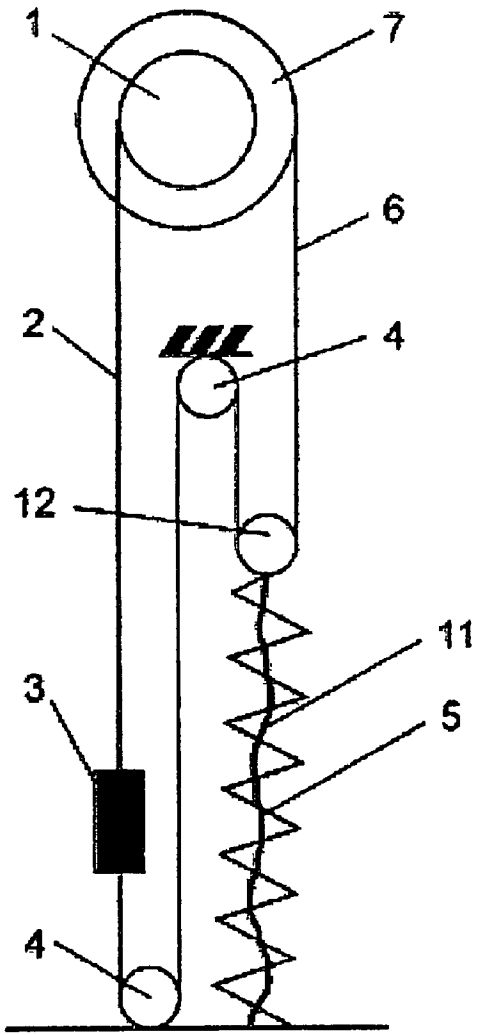
FIG. 14 is a side view of a door system with a pulley and a mechanical stop according to the present invention.

It will be appreciated by those of skill in the art that a variety of combinations of the springs or biasing means in combination with anti-crash or other safety means can be incorporated into the designs of the present invention. For example FIG. 14 depicts a high load operation door similar to that shown in FIG. 2, where the elongation stopper is replaced by a length of chain, rope, wire or the like 11 which limits the travel of the tension spring 5. As a safety feature, the chain 11 can be used in combination with a "weak link" mechanism (not shown) to protect the components of the door in the event of a crash, or other high load incidents.

Figure 15:
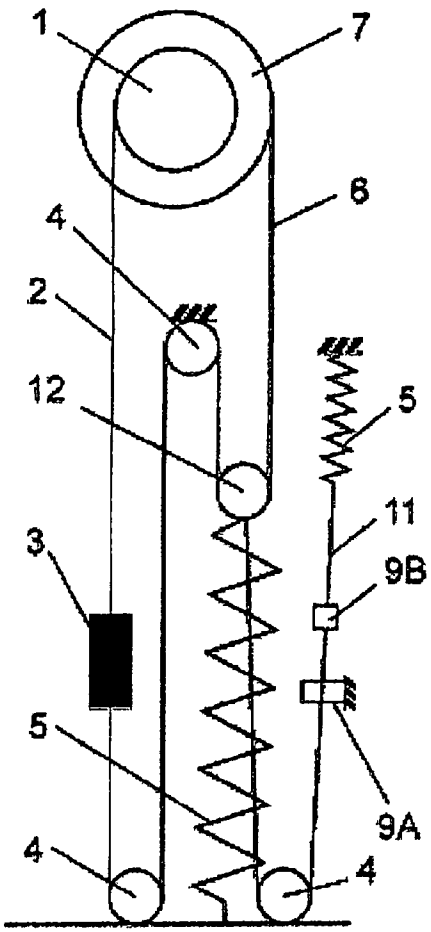
FIG. 15 is a side view of a door system with a pulley and a mechanical stop according to the present invention.

FIG. 15 shows a further variation of the high load door depicted in FIG. 2 further comprising a second tension resisting spring 5, and a mechanical elongation stopper 9A & 9B. The two springs are in series and both resist the movement of door, while the mechanical stopper 9A and 9B prevents the movement of the springs 5 and ultimately the door curtain 2 beyond a predetermined point.

Figure 16:
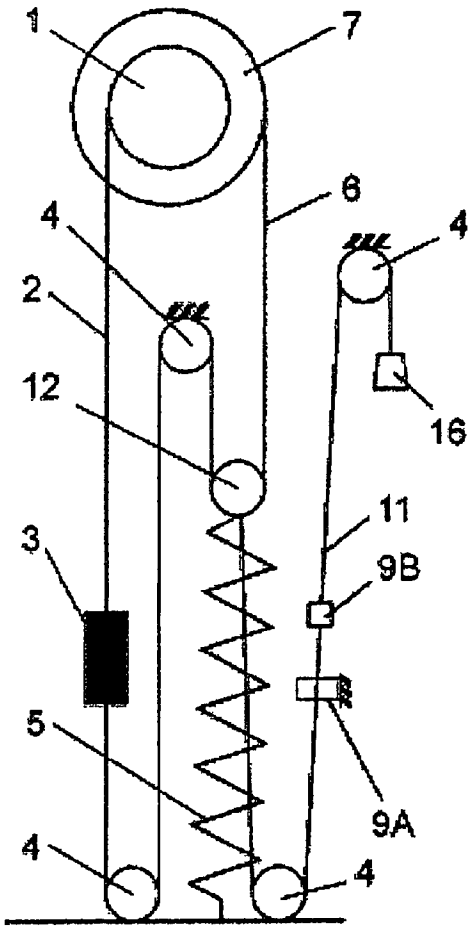
FIG. 16 is a side view of a door system with a pulley and a weighted mechanical stop according to the present invention.

FIG. 16 shows a high load door which is nearly identical to that shown in FIG. 15, the main difference being that a weight 16 is substituted for the second spring 5. The weight 16 works in concert with the spring 5 to prevent the door curtain 2 from rising. Naturally, the mass of the weight can be optimized, by those of skill in the art, for a specific application.

FIG. 17 depicts another embodiment of the high load door according to the present invention. The embodiment shown in FIG. 17 combines the electro-mechanical lock and release mechanism 10 shown in the embodiment of FIG. 13 used in combination with the double spring 5 and mechanical stopper 9A and 9B shown in FIG. 15. In this embodiment, the movement of the two springs 5 is limited by the mechanical stopper 9A and 9B until the occurrence of an event which releases the electromechanical lock mechanism 10, thereby releasing portion 9A of the mechanical stopper and allowing the force applied to the door curtain 2 to act on the springs 5.

Figure 19:
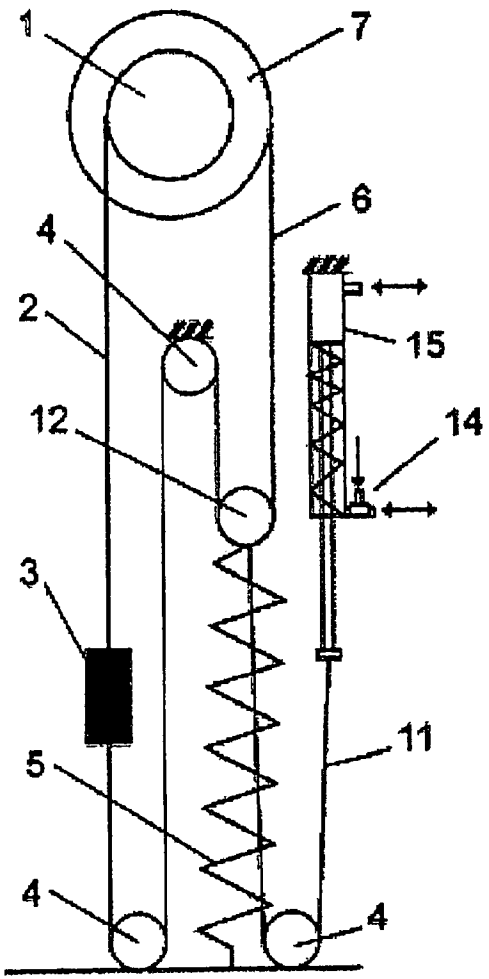
FIG. 19 is a side view of a door system with a pulley and a pneumatic piston positive stop according to the present invention.
Figure 18:
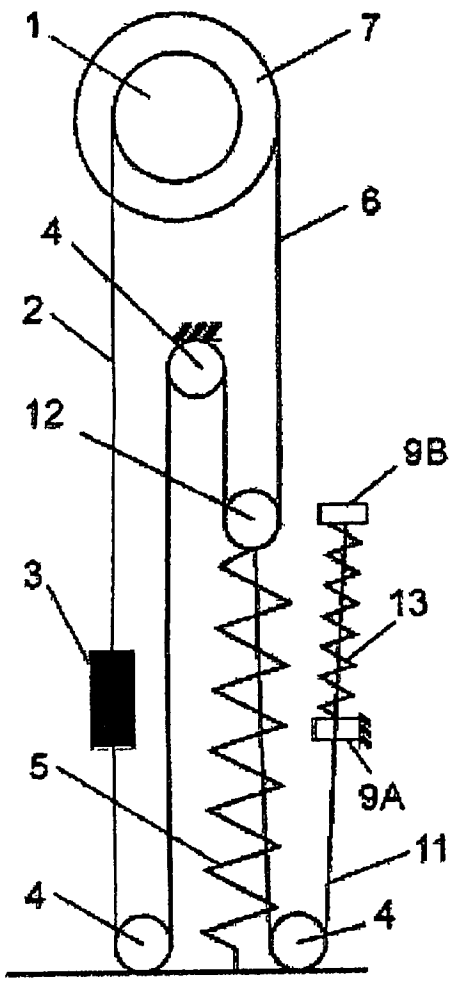
FIG. 18 is a side view of a door system with a pulley and a mechanical spring positive stop according to the present invention.

FIG. 18 shows yet another embodiment of the present invention using a compression resistant spring 13 and a tension resistant spring 5. The compression resistant spring 13 works in conjunction with a mechanical stopper 9A and 9B to limit the travel of the door curtain 2. While the compression resistant spring 13 and the tension resistant spring 5 work to slow or prevent the movement of the door curtain 2 within the travel limit. FIG. 19 depicts a nearly identical system to that shown in FIG. 18 except that the compression resistant spring 13 is replaced with a pneumatic or gas spring 15. As shown in FIG. 19, the gas spring 15 can include one or more pressure valves 14 that can be used to assist in limiting the travel of the door curtain 2. Similar functionality using valves could be obtained by substituting a hydraulic spring arrangement for the pneumatic spring.

A further embodiment of the present invention is shown in FIG. 20 comprising a compression resistant spring 13 used in combination with a mechanical stopper 9A and an electromechanical lock and release mechanism 10.

Figure 21:
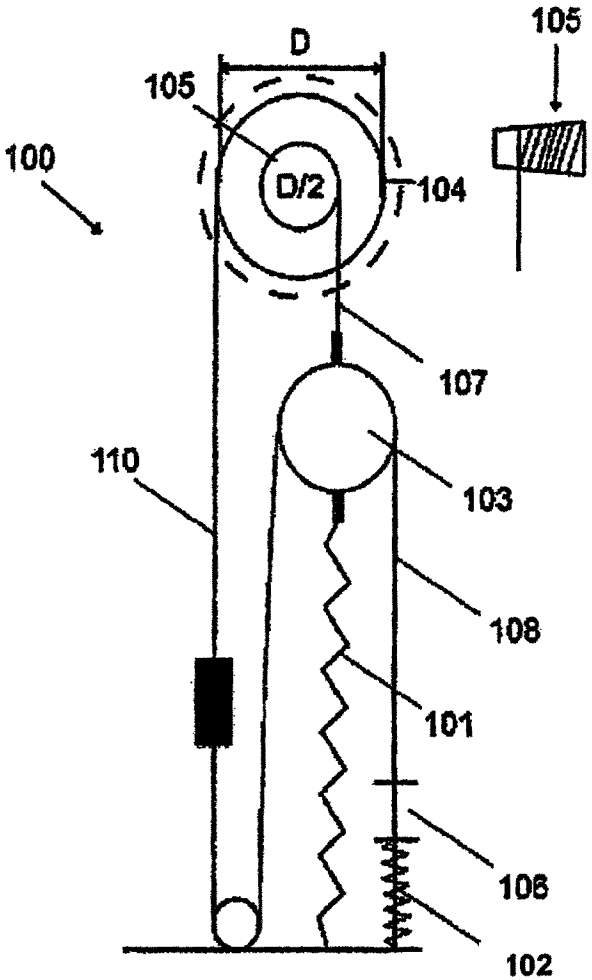
FIG. 21 is a side view of a door system with a connection pulley and a frusto-conical cable drum according to the present invention.

Yet a further example of the present invention is shown in FIG. 21. In FIG. 21 a door system 100 is shown including a pull down and stretch systems. The system comprises a compression resistant or balance spring 101, a tension resistant or pull down spring 102, a connection pulley 103, a door blade roll 104, a frusto-conical cable drum 105, a first cable 107, and a second cable 108. Optionally, the system may also comprise a spring stopper 106 that limits the extension of the pull down spring 102.

In one preferable embodiment the frusto-conical cable drum 105 is half the diameter (D/2) of the door curtain roll 104. In this embodiment the door curtain roll 104 and the frusto-conical cable drum 105 rotate at the same speed and in the same direction. During the opening and closing operations, the diameter of the effective portion of the frusto-conical cable drum 105 i.e., that portion upon which the first cable 107 is acting at one point in time, is reduced at a rate similar to the change in thickness of the door blade roll 104. That is as the door curtain 110 is lowered, the thickness of the door curtain roll 104 is reduced. At the same time, the frusto-conical cable drum 105 takes up the first cable 107, and as more cable is taken up the cable spooled onto the frusto-conical cable drum 105 is wrapped at a successively smaller diameter portion of the frusto-conical cable drum 105. This results in connection pulley only moving approximately ½ the distance of the door curtain 110, during an opening or closing operation. In addition, because the system is effectively balanced by the frusto-conical cable drum 105, there is little or no movement in the pull down spring 102, while there is relatively constant pressure being applied to both the door curtain 110 and the frusto-conical cable drum 105 by the first and second cables 107 and 108, respectively.

The spring stopper 106 limits the elongation of the pull down spring 102. The drive unit (not shown) and second cable 108 keep the door curtain 110 stretched and pull down the door curtain 110 with greater tension that would be possible by the pull down spring 102 would be capable of alone. Thus the door can be closed even when subjected to high winds. When known to be used in high wind applications, the spring stopper 106 should be adjusted with a minimal gap to prevent jams and overstretching of the cables.

In certain applications it may be desirable to utilize a frusto-conical cable drum (105) that has a diameter of greater than D/2 of the door curtain roll 104. Such a configuration will result in the pull down spring 102 being restricted by the spring stopper 106 when the door curtain 110 is in the closed position. When in this position, the bottom beam will therefore be less vulnerable to a collision with, for instance, a vehicle since the bottom beams and door curtain can leave the side guide tracks. Accordingly, typical bottom beam break away systems and self-repairing functions known in the art may readily be implemented. Also, when the spring stopper 106 is acting on pull down spring 102, the door curtain 110 is being forced down by the drive unit through the first and second cables.

Other options that may be included in this configuration include the use of additional pulleys to limit the amount of travel of connection pulley 103, which in turn would allow the cable drum 105 diameter to be increased. Extra pulleys would also limit the elongation of balance spring 101.

Figure 22:
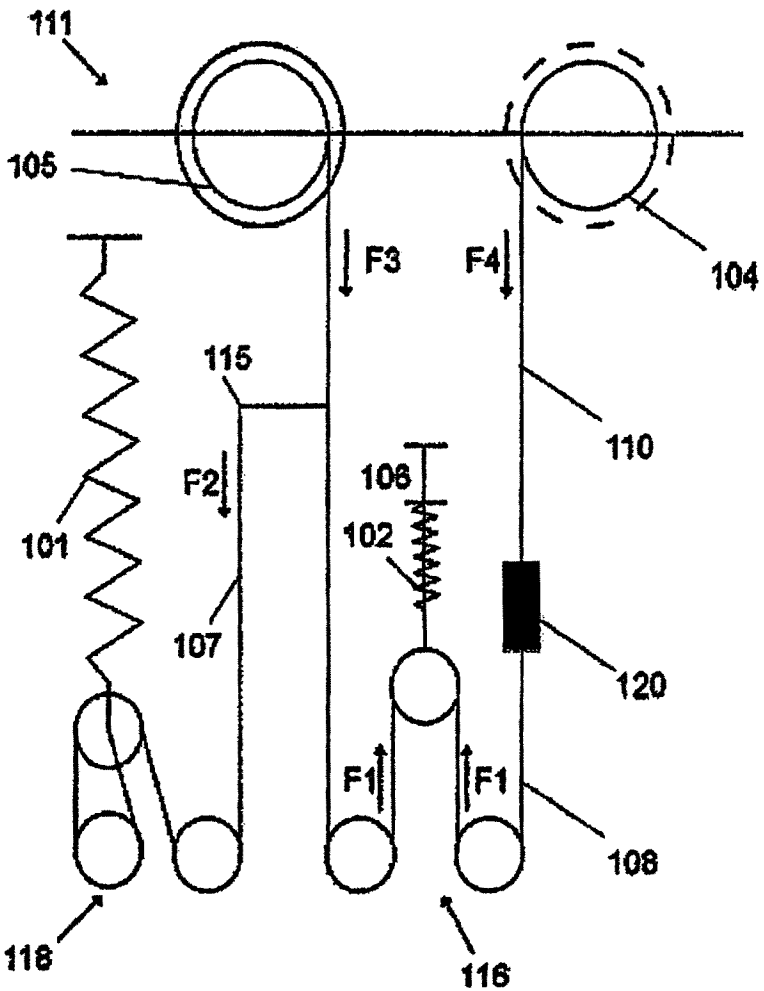
FIG. 22 is a side view of a door system with a connection pulley and a frusto-conical cable drum according to the present invention.

Such a system as described in connection with FIG. 21 allows the door to be operated at a desired stretch and pull down force, which allows for the spring sizes to be optimized for a given application. Advantageously, the system requires only a single cable drum on either side of the door to be effective both for support and balancing the door. Further, because the system is essentially balanced, the size of the pull down spring 102 can be reduced and its travel is limited to essentially zero. Still further, when used in combination with a spring stopper 106 and where the drive unit is prevented from traveling backwards when not in use, the door is effectively locked, thereby increasing security of the door. Finally, such a configuration utilizes the torque from the drive unit to both pull down and pull up the door curtain during the entirety of the opening and closing operations, thus making it usable in very high wind applications. Another embodiment of the present invention is shown in FIG. 22. Though depicted as two separate wheels, in practice the frusto-conical cable drum 105 and the door roll 104 are in actuality on the same axis, they are shown separated in FIG. 22 to ease interpretation of the drawing. The door roll 104 houses a door curtain 110, which is connected to a first cable 108. The first cable 108 is connected to the frusto-conical cable drum 105 via a combination of three pulleys 116. At least one of the combination of three pulleys is connected to a tension resistant or pull down spring 102. The pull down spring may optionally be connected to a spring stopper 106, that may optionally include an adjustable gap. The first cable 108 is connected to a second cable 107 by a wire joint 115. The second cable 107 traverses at least one pulley 118, and preferably a combination of three pulleys to connect to a balance or compression resistant spring 101.

The door system 111 shown in FIG. 22 has the stretch system separated from the balance system. The balance portion of the system 111 is that portion extending from the wire joint 115 to the balance spring 101, while the stretch system is that portion of the system 111 extending from the door curtain 110 to the wire joint 115. The diameter of the door roll 104 is dependent upon the door curtain 110 thickness and varies depending upon the position of the door from a maximum diameter when the door is completely opened, and a minimum diameter when the door is completely closed.

As the door curtain 110 is rolled up or down, the frusto-conical shape of the cable drum 105 accounts for the change in diameter of the door roll 104 allowing for a balancing of the forces applied to the door curtain 110. Because the door roll 104 and the frusto-conical cable drum 105 are on the same axis, they rotate at the same speed. Use of the frusto-conical shape of the cable drum 105 accounts for the changing rotational speed and torque that are applied by the cable drum 105 and the door roll 104 when engaged in either a raising or lowering operation of the door curtain 110. Small variations in difference in size between the frusto-conical cable drum 105 and the door roll 104 are accommodated by the pull down spring 102. Further, in at least one embodiment the pitch ratio of the frusto-conical cable drum 105 is designed to be higher than the pitch ration of the door roll 104.

A stretch force F1 is applied by the pull down spring 102, and may be optimized for a particular installation. The pull down spring 102 resists stretching of the door curtain 110 when experiencing high wind loads, and prevents the door curtain 110 from moving in the vertical direction when under such loads. The spring stopper 106 may be used to prevent the over extension of the pull down spring 102, and further prevent movement of the door curtain 110 when under extreme conditions, where the pull down spring 102 alone would not prevent movement of the door curtain 110. Further, the gap between the spring stopper 106 and the pull down spring 102 may be optimized so that the spring is effective throughout the operation of the door, thereby always providing some pull down force, F1. Still further, the adjustable gap may be set so that when the door is in a closed position zero gap is available, thereby preventing any movement of the door blade 110. In some embodiments, the door curtain 110 will better withstand high loading conditions by use of a bottom beam 120.

The stretch force F1 does not affect the balance of the system. As the door curtain 110 is opened or closed the diameter of the door roll 104 and the frusto-conical cable drum 105 remains approximately the same. Torque from F3 on the frusto-conical cable drum 105 will thus be nearly identical but of the opposite sign as the torque applied by the force F4 on the door roll 104, thus resulting in a near balanced system. Any difference is accounted for with the balance spring 101.

The force F3 on the frusto-conical cable drum 105 is approximately equal to the force F4 on the door roll 104. Force F2 imparted by the balancing spring 102 is approximately equal to the force created by ½ of the weight of the door curtain 110 and bottom beam 120, when the system is in a balanced state. While the door curtain 110 is moving in the downward direction, force F4 increases, but is balanced by a counteracting increase in F2 imparted by the balance spring. Thus the system remains balanced throughout operation, whether moving in the upward or downward directions.

Thus by the foregoing examples, the objects and advantages of the present invention are realized, and although preferred embodiments have been disclosed and described in detail herein, its scope and objects should not be limited thereby; rather its scope should be determined by that of the appended claims.

What is claimed is:

1. A rolling door comprising:

a roll and a means for collecting a cable positioned near an aperture for the door and provided with a drive system; a door curtain to be wound upon the roll and unwound from said roll; a biasing means operable to travel/stretch when an external load is applied to the curtain;

the cable to be wound/unwound from said means for collecting said cable, and having a first end connected to a bottom of said curtain, the cable running therefrom over pulleys, and a second end of the cable being connected to the cable-collecting means;

wherein means for collecting said cable is a frustro-conical cable drum; and means for preventing the biasing means from traveling beyond a predetermined point, so to prevent movement of the curtain when the load is applied to the curtain when in a closed position.

2. The rolling door of claim 1, wherein the biasing means is positioned on one side of the door or near one of a first end of the door or an opposite end thereof.

3. The rolling door of claim 1, wherein the biasing means are arranged on each side of the door and connected in one of parallel or serial arrangement.

4. The rolling door of claim 1, wherein the biasing means comprises one or more springs.

5. The rolling door of claim 4, wherein the springs can be selected from the group consisting of tension resistant springs, compression resistant springs, hydraulic springs, and pneumatic springs.

6. The rolling door of claim 5, wherein two or more springs are connected in series.

7. The rolling door of claim 5, wherein two or more springs are connected in parallel.

8. The rolling door of claim 1, wherein the biasing means comprises rubber rope or ropes connected in parallel or loops.

9. The rolling door of claim 1, wherein the biasing means is one or more gas springs.

10. The rolling door of claim 1, wherein the biasing means is a spring element, such that said spring also acts as the means for preventing itself from traveling beyond a predetermined point when the spring is either elongated or compressed maximally.

11. The rolling door of claim 1, wherein the biasing means is a counterweight.

12. The rolling door of claim 1, wherein said means for preventing said biasing means from traveling beyond said predetermined point is positioned at one of a first end of the door end or the opposite end thereof.

13. The rolling door of claim 1, wherein a rigid stop is provided as said means for preventing biasing means travel.

14. The rolling door of claim 1, wherein the load applied is one of a wind force, pressure differences caused by air-conditioning fans, a vertical force, or a horizontal force.

15. The rolling door of claim 1, further comprising means for preventing movement of the roll when the load is applied to the closed curtain.

16. The rolling door of claim 15, wherein said means for preventing roll movement is a drive system brake.

17. The rolling door of claim 15, wherein said means for preventing roll movement is a locking mechanism.

18. The rolling door of claim 1, further comprising one of a mechanical or electromechanical lock for fixing the door curtain in a closed position.

19. The rolling door of claim 1, further comprising one or more of a door curtain edge fixing device, wind bars, or stiff door curtain reinforcements.

20. The rolling door of claim 1, wherein said cable experiences minimal elongation when under tension.

21. The rolling door of claim 1, wherein said door is provided with an anti-crash function.

22. The rolling door of claim 21, wherein said anti-crash function operates fully when the door is in a substantially open position.

23. The rolling door of claim 18, wherein a sensor is capable of releasing the lock to support the anti-crash function.

24. The rolling door of claim 21, wherein said door is provided with an anti-crash function that operates fully when the door curtain is in any of an open, closed or intermediate positions.

25. The rolling door of claim 1, wherein said rolling door is oriented in one of a vertical, horizontal, or angled directions.

26. The rolling door of claim 1, wherein the door curtain comprises one of coated fabric, polymeric film, or slats.

27. The rolling door of claim 1, wherein the door curtain is flexible only in a rolling direction.

28. The rolling door of claim 1, wherein a bottom beam is attached to the bottom of the door curtain.

29. The rolling door of claim 1, wherein said means for collecting said cable is a cable drum.

30. A rolling door comprising:

a roll and a means for collecting a first cable positioned near an aperture for the door and provided with a drive system;

a door curtain to be wound upon the roll and unwound from said roll;

a biasing means operable to travel/stretch when an external load is applied to the curtain;

the first cable being wound/unwound from said cable-collecting means and having one end connected thereto, the first cable running therefrom over first and second pulleys;

and the other cable end being connected to a reduction pulley; and a second cable with one end being fixed, the second cable running over the reduction pulley and a third pulley, and the other cable end being connected to the door curtain;

wherein means for collecting said cable comprises a cable drum having a diameter smaller than the roll diameter.

31. The rolling door of claim 30, further comprising means for preventing the biasing means from traveling beyond a predetermined point, so to prevent movement of the door curtain when the load is applied.

32. The rolling door of claim 30, wherein the biasing means is positioned on one side of the door or near one of a first end of the door or an opposite end thereof.

33. The rolling door of claim 30, wherein the biasing means are arranged on each side of the door and connected in one of parallel or serial arrangement.

34. The rolling door of claim 30, wherein the biasing means comprises one or more springs.

35. The rolling door of claim 34, wherein the springs can be selected from the group consisting of tension resistant springs, compression resistant springs, and pneumatic springs.

36. The rolling door of claim 35, wherein two or more springs are connected in series.

37. The rolling door of claim 35, wherein two or more springs are connected in parallel.

38. The rolling door of claim 30, wherein the biasing means comprises rubber rope or ropes connected in parallel or loops.

39. The rolling door of claim 30, wherein the biasing means is one or more gas springs.

40. The rolling door of claim 30, wherein the biasing means is a spring element, such that said spring also acts as the means for preventing itself from traveling beyond a predetermined point when the spring is either elongated or compressed maximally.

41. The rolling door of claim 30, wherein the biasing means is a counterweight.

42. The rolling door of claim 30, wherein said means for preventing said biasing means from traveling beyond said predetermined point is positioned at one of a first end of the door end or the opposite end thereof.

43. The rolling door of claim 31, wherein a rigid stop is provided as said means for preventing biasing means travel.

44. The rolling door of claim 30, wherein the load applied is one of a wind force, pressure differences caused by air-conditioning fans, or a vertical force.

45. The rolling door of claim 30, further comprising means for preventing movement of the roll when the load is applied to the closed curtain.

46. The rolling door of claim 45, wherein said means for preventing roll movement is a drive system brake.

47. The rolling door of claim 45, wherein said means for preventing roll movement is a locking mechanism.

48. The rolling door of claim 30, further comprising one of a mechanical or electromechanical lock for fixing the door curtain in a closed position.

49. The rolling door of claim 30, further comprising one or more of a door curtain edge fixing device, wind bars, or stiff door curtain reinforcements.

50. The rolling door of claim 30, wherein said cable experiences minimal elongation when under tension.

51. The rolling door of claim 30, wherein said door is provided with an anti-crash function.

52. The rolling door of claim 51, wherein said anti-crash function operates fully when the door is in a substantially open position.

53. The rolling door of claim 48, wherein a sensor is capable of releasing the lock.

54. The rolling door of claim 51, wherein said door is provided with an anti-crash function that operates fully when the door curtain is in any of an open, closed or intermediate positions.

55. The rolling door of claim 30, wherein said rolling door is oriented in one of a vertical, horizontal, or angled directions.

56. The rolling door of claim 30, wherein the door curtain comprises one of coated fabric, polymeric film, or slats.

57. The rolling door of claim 30, wherein the door curtain is flexible only in a rolling direction.

58. The rolling door of claim 30, wherein a bottom beam is attached to the bottom of the door curtain.

59. The rolling door of claim 30, wherein said means for collecting said cable is a cable drum.

60. A rolling door comprising:

a roll upon which a door curtain may be rolled and unrolled positioned near an aperture for the door and provided with a drive system;

a means for collecting a first cable operably connected to the roll and drive system;

a biasing means operable to travel/stretch when high winds or other external force causes a heavy loading on the door curtain;

the first cable being wound/unwound from said cable-collecting means and having one end connected thereto a second end of said first cable connected to a connection pulley; and a second cable having one end operably connected to at least a portion of the biasing means, the second cable running over the connection pulley, and the other cable end being connected to the door curtain.

61. The rolling door of claim 60, wherein the means for collecting the first cable is a frusto-conical cable drum.

62. The rolling door of claim 60, wherein the biasing means comprises first and second springs.

63. The rolling door of claim 62, wherein the second spring is a tension resistant spring.

64. The rolling door of claim 62, wherein the first spring is a compression resistant spring.

65. The rolling door of claim 61, wherein the frusto-conical cable drum has a diameter approximately ½ the diameter of the roll.

66. The rolling door of claim 60 further comprising a spring stopper for the limiting the travel of the biasing means.

* * * * *

UNITED STATES PATENT AND TRADEMARK OFFICE

CERTIFICATE OF CORRECTION

PATENT NO. : 8,162,028 B2
APPLICATION NO. : 11/587226
DATED : April 24, 2012
INVENTOR(S) : Mikael Bengtsson et al.

It is certified that error appears in the above-identified patent and that said Letters Patent is hereby corrected as shown below:

On the cover page of the patent, the following information should be added after the Prior Publication Data:

Related U.S. Application Data

(63) Continuation-in-part of application No. 10/838,783, filed on May 4, 2004, now Pat. No. 7,252,133

Signed and Sealed this
Twelfth Day of June, 2012

David J. Kappos

David J. Kappos
*Director of the United States Patent and Trademark Office*